US011607604B1

(12) United States Patent
Current

(10) Patent No.: US 11,607,604 B1
(45) Date of Patent: Mar. 21, 2023

(54) JESTER RULES 3-D CHESS

(71) Applicant: Terry Lee Current, Poulsbo, WA (US)

(72) Inventor: Terry Lee Current, Poulsbo, WA (US)

(73) Assignee: Terry Current, Poulsbo, WA (US)

( * ) Notice: Subject to any disclaimer, the term of this patent is extended or adjusted under 35 U.S.C. 154(b) by 0 days.

(21) Appl. No.: 17/738,860

(22) Filed: May 6, 2022

(51) Int. Cl.
*A63F 3/02* (2006.01)

(52) U.S. Cl.
CPC ..... *A63F 3/02* (2013.01)

(58) Field of Classification Search
CPC ..... A63F 3/02
See application file for complete search history.

(56) References Cited

U.S. PATENT DOCUMENTS 383,653 A * 5/1888 Monks ..... A63F 3/02 273/258
D221,390 S * 8/1971 Skillman ..... D21/336
D223,939 S * 6/1972 Palazzolo ..... D21/336
4,696,476 A * 9/1987 Eplett ..... A63F 3/00214 273/287
6,412,778 B1 * 7/2002 Alaimo ..... A63F 3/00214 D21/348
7,219,895 B1 * 5/2007 Hutchins, Jr. ..... A63F 3/02 273/261

FOREIGN PATENT DOCUMENTS

WO WO-2007067273 A2 * 6/2007 ..... A63F 3/00157

OTHER PUBLICATIONS

"Chess", Wikipedia article, https://en.wikipedia.org/wiki/Chess, archived Jan. 2, 2018 (Year: 2018).*
Stuart Spence Blog, "Release 1.13: Eight More Rules and Seven More Languages!", https://blog.stuartspence.ca/chesscraft-release-1.13.html, posted Jul. 1, 2021 (Year: 2021).*
George Jelliss, "Cylinder Chess", Variant Chess, vol. 3, issue 22, Winter 1996-7, p. 32-33, available online at http://www.bcvs.ukf.net:80/cylin.htm (Year: 1996).*
D. B. Pritchard, "The Classified Encyclopedia of Chess Variants", second edition, completed and edited by John Beasley, copyright 2007, p. 76-80, available online at https://www.jsbeasley.co.uk/encyc/encyc.pdf (Year: 2007).*
"10 × 10 Jester Chess", https://www.mastersofgames.com/cat/board/chess-jester.htm, archived Aug. 1, 2020 (Year: 2020).*
"Portal Chess", https://www.chessvariants.com/boardrules.dir/portal.html, archived Apr. 19, 2016 (Year: 2016).*

* cited by examiner

*Primary Examiner* — Laura Davison

(57) ABSTRACT

A chess-based game system which is a novel variation of traditional chess, includes a unique gameboard, and a new "Jester" game piece, in addition to the pieces of traditional chess. Furthermore, the disclosed system game rules provide for unique moves and a variable initial setup of the game pieces.

1 Claim, 3 Drawing Sheets

JESTER RULES 3-D CHESS

BACKGROUND

The present disclosure relates generally to board games, and more specifically to a novel chess-based game system.

Chess is a well-known game of deep thinking and abstract strategy. The disclosed subject matter provides a novel chess-based game system which is a variation of traditional chess, and which adds excitement and diversity.

SUMMARY

According to various embodiments, disclosed is a chess-based game method and/or system for play by two players, which may comprise providing a gameboard that includes a checkered grid of spaces; a first castle section occupying a first corner space at a first corner of the gameboard and a plurality of spaces adjacent to the first corner space; a first player treasure piece; a second castle section occupying a second corner space at a second corner of the gameboard opposite the first corner, the second castle section further occupying a plurality of spaces adjacent to the second corner space; and a second player treasure piece. In embodiments, the chess based game system may further comprise providing first player chess-based game pieces designated for a first player of the two players, the first player chess-based game pieces comprising a first player king, and at least one of a first player pawn, a first player rook, a first player knight, a first player bishop, a first player queen, or combinations thereof; and providing second player chess-based game pieces designated for a second player of the two players, the second player chess-based game pieces comprising a second player king, and at least one of a second player pawn, a second player rook, a second player knight, a second player bishop, a second player queen, or combinations thereof; and providing a first player jester piece designated for the first player, and a second player jester piece designated for the second player.

In further embodiments, the two players set up the game pieces on the gameboard by placing each piece of each player's designated game pieces within a space of the checkered grid of spaces. In certain embodiments, the initial setup may be fixed; however, in other embodiments, the initial setup may be determined by each of the players. In some further embodiments, the chess-based game system may comprise instructing the two players to take turns moving the pieces within the gameboard according to a set of rules, wherein the set of rules provide that: each of the chess-based game pieces can be moved according to its chess-based pattern of movement, the first player jester piece and the second player jester piece can be moved according to the chess-based pattern of movement of either the queen or the knight, and the game is won when one of the two players either captures the other player's treasure piece which is located within that player's castle section, or check mates the other player's king.

In some embodiments, the gameboard further comprises a designated space within the checkered grid of spaces defining a portal, wherein the set of rules further provide that a piece which is moved into the portal can then be moved to an edge space of the checkered grid of spaces by the player that moved the piece into the portal. In further embodiments, the set of rules provide that the first player king can be moved from the portal to a treasure room within the second castle section, that the second player king can be moved from the portal to a treasure room within the first castle section, and that the other game pieces cannot be moved from the portal to either one of the first or second castle sections. In some further embodiments, the first castle section and the second castle section each comprise a portcullis designated for guarding the respective player's treasure, wherein the set of rules further provide that upon one player's movement of a piece into the portal, the other player's portcullis is opened leaving that player's treasure subject to being captured. In some embodiments, the checked grid of spaces comprises 121 squares that are arranged in 11 rows and 11 columns, and wherein the squares alternate in colors according to a checkerboard pattern. In certain embodiments, the first castle section and the second castle section each occupy six spaces within the checkered grid of spaces, including a corner space, two edge spaces adjacent to the corner space on a first side of the corner space, two edge spaces adjacent to the corner space on a second side of the corner space, and a central space diagonally in front of the corner space, wherein the central space is designated for placement of the respective player's treasure. In further embodiments, each of the first castle section and the second castle section form a multi-tiered section which is elevated with respect to the remaining spaces of the checkered grid of spaces, and wherein the corner space of each of castle section is the highest tier. In some further embodiments, the gameboard comprises castle shadow sections occupying corner spaces at corners of the gameboard between the first corner and second corner, each castle shadow section further occupying a plurality of spaces adjacent their respective corner spaces. In some embodiments, the set of rules further provide that any piece may start a move at one edge of the board, and continue and complete its move through an opposite edge of the board, wherein opposite edges of the board are treated as contiguous to one another for completing the move. In yet further embodiments, the set of rules allow each player to set up the game pieces on the gameboard according to that player's initial setup choice. In embodiments, the gameboard and pieces are physical items. In an alternate embodiment, the items of the game system may be virtually provided on a computerized medium.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

Figure 1:
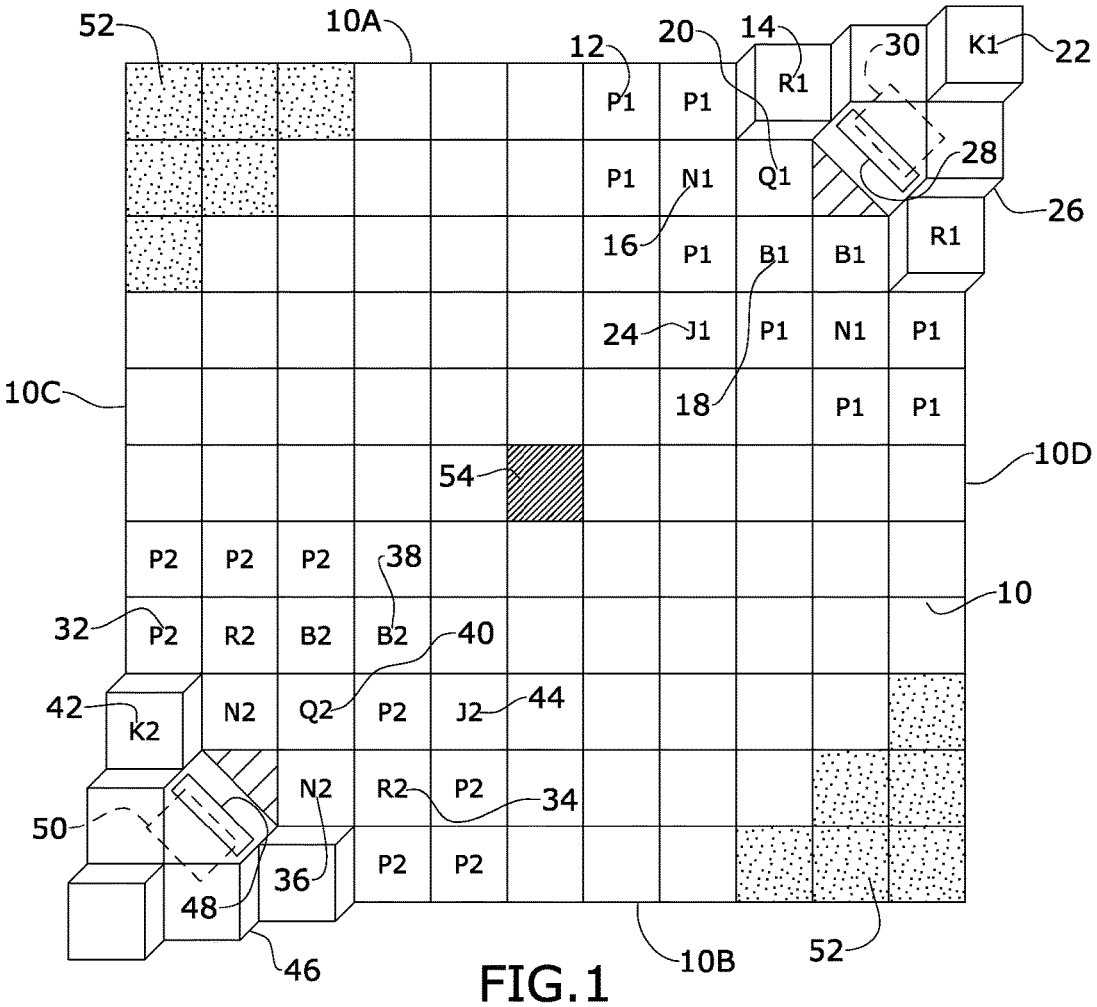
FIG. 1 illustrates a diagram of a chess-based game system, including a board game, and game pieces, wherein the game pieces are shown in an initial setup arrangement according to certain embodiments.
Figure 2:
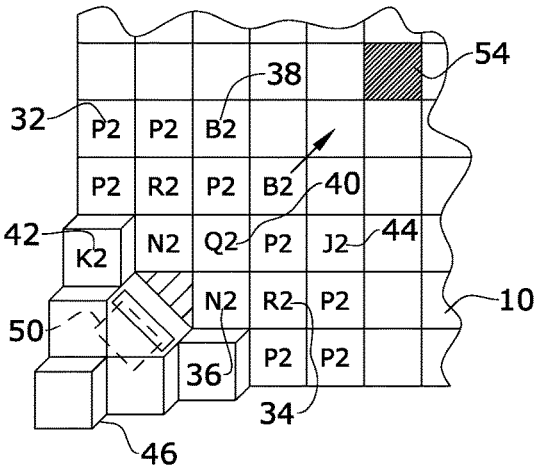
FIG. 2 illustrates the player 2 side of the game system of FIG. 1.
Figure 3:
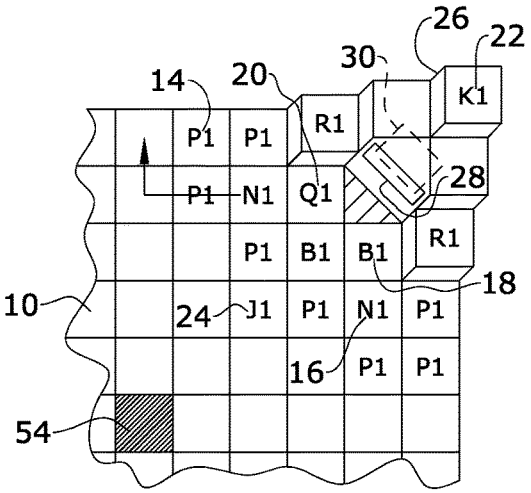
FIG. 3 illustrates the player 1 side of the game system of FIG. 1

The game of chess is world renowned as a game of logic and deep strategic thinking. The disclosed subject matter introduces a chess-based game system 1 for two opponent players (referred to as player 1, and player 2) which is a novel variation of traditional chess.

According to various embodiments and with reference to FIGS. 1-7, the disclosed game system introduces a unique gameboard 10, and a new "Jester" game piece, in addition to the pieces of traditional chess. Furthermore, the disclosed system game rules provide for unique moves and a variable initial setup of the game pieces.

Gameboard

In embodiments, the disclosed game system comprises a gameboard 10 that includes a checkered grid of spaces or boxes, a designated space within the checkered grid of spaces defining a portal 54, and designated spaces within the checkered grid of spaces defining castle shadow sections 52. In some embodiments, portal 54 (also referred to as "jester's portal 54") may be located at the center of the board. In some further embodiments, castle shadow sections 52 may be located at opposite corners of the board, and may occupy six boxes, including a corner box, two edge boxes to the left of the corner box and two edge boxes to the right of the corner box, and a central box diagonally forwards of the corner box, as shown. In certain embodiments, gameboard 10 may further comprise a first player castle 26 including a first player portcullis 28, and a second player castle 46 including a second player portcullis 48. In embodiments, the first and second player castles 26, 46, may be multi-tiered sections located at the corners between castle shadow sections 52. In some further embodiments, game system 10 may include "treasure" pieces including treasure 30 for player 1, and treasure 50 for player 2, which are placed within "treasure rooms" of each player's castle and are guarded by the portcullises 28, 48, respectively. In embodiments, the first player castle 26 and second player castle 46 include steps or "castle tiers" which provide the gameboard with a three-dimensional quality. In some embodiments, castles 26, 46 may each include 5 castle tiers, arranged in an "L" configuration, wherein the central tier is the highest tier and is positioned at the corner of the gameboard between the castle shadow sections, and the four other tiers form steps descending downwards from left and right sides of the central tier to cover two adjacent edge squares on the left and right sides of the central corner square as shown, with the "treasure room" holding treasures 30, 50, located centrally between the other castle tiers and diagonally forwards from the central corner square. As such, each castle covers 6 squares, wherein the first player castle 26 includes a treasure room holding a first player treasure 30, guarded by first player portcullis 28, and second player castle 46 includes a treasure room holding a second player treasure 50, guarded by second player portcullis 48. In certain embodiments, gameboard 10 has 11×11 squares, or a total of 121 squares, wherein the squares outside the castle shadow sections 52 and castles 26, 46, alternate colors in checkerboard style.

Game Pieces

In embodiments, chess-based game system 1 introduces novel "jester" pieces 24, 44 (also designated in the figures by J1 for player 1, and J2 for player 2), in addition to traditional chess-based game pieces. In embodiments, the chess-based game pieces of game system 1 may be configured to move according to the rules of traditional chess, and may include pawns 12, 32 (designated in the figures by P1 for player 1, and P2 for player 2), rooks 14, 34 (designated in the figures by R1 for player 1, and R2 for player 2), knights 16, 36 (designated in the figures by N1 for player 1, and N2 for player 2), bishops 18, 38 (designated in the figures by B1 for player 1, and B2 for player 2), queens 20, 40 (designated in the figures by Q1 for player 1, and Q2 for player 2), kings 22, 42 (designated in the figures by K1 for player 1, and K2 for player 2). In certain embodiments, each player (i.e., player 1 and player 2) may have 17 pieces, including eight pawns, two rooks, two knights, two bishops, one queen, one king, and one jester. The pieces may be of different colors, e.g., black for player 1 and white for player 2, and/or include some other visual element to distinguish between the player 1 pieces and the player 2 pieces. It shall be appreciated that different numbers of game pieces and/or combinations of game pieces may be used in alternate embodiments.

Initial Setup

Figure 4:
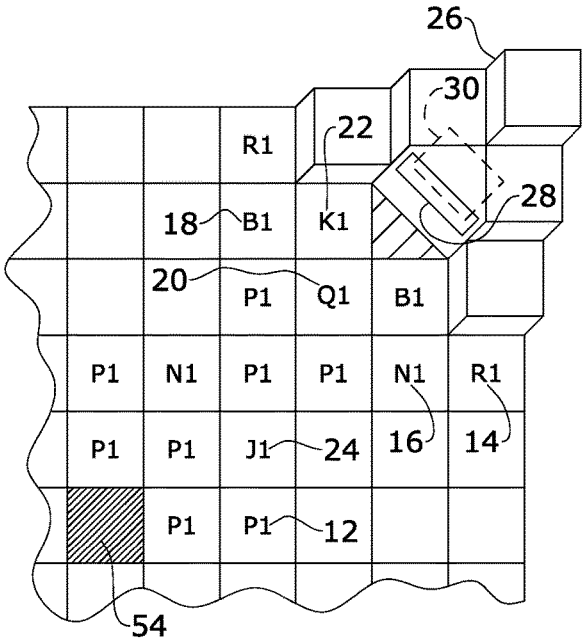
FIG. 4 illustrates an example of an alternate initial setup arrangement for the game system of FIG. 1.
Figure 5:
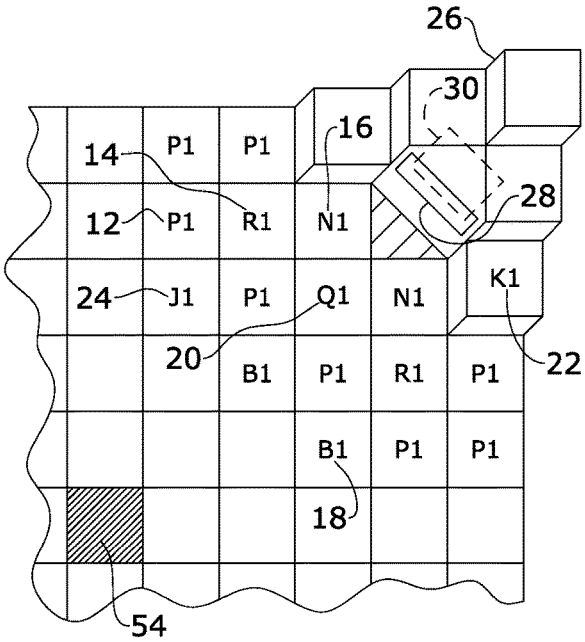
FIG. 5 illustrates another example of an alternate initial setup arrangement for the game system of FIG. 1.

Unlike traditional chess which has a fixed placement of the game pieces at the start of a game, the disclosed game system may offer the players a choice of a fixed or variable initial setup according to various embodiments. As such, the players may agree to the same initial setup for each player, or to a variable setup wherein each player determines initial placement of her pieces on the gameboard. In certain embodiments, the rules of the game may require a fixed initial position for certain pieces, but not others. In one embodiment, the rules may require the king to start in the castle (e.g., at one of the castle tiers). In certain embodiments, the gameboard may be divided diagonally via a line extending between opposite corners of the castle shadow sections and crossing the Jester's Portal, wherein each player may freely set up his/her pieces on his/her respective half of the board. In another embodiment, the players may each freely set up their pieces anywhere on the board. In further embodiments, the rules of the game may require each player's king to be positioned within that player's castle. Examples of different initial setups are shown in FIGS. 1, 4, and 5. In certain embodiments, the younger player may start first, and/or the player may agree by other means as to which player starts first.

Movability of the Game Pieces

According to various embodiments, the rules of game system 1 generally allow the game pieces to move across the gameboard, based on their movability in traditional chess. In certain embodiments, the rules of game system allow the pieces to freely move within the castle shadows sections but restrict the pieces from performing an "edge transport move" (described below) from the castle shadow sections. Additionally, all pieces, except for the bishop, may move into the castle section/castle tiers during regular play. However, during a portal move (described below), none of the pieces may transport to the castle section, except for the king which may use a portal move to transport into the opponent's treasure room.

Portal Move

In some embodiments, the rules of game system 1 may include a "portal move" which allows a player to move any piece into jester's portal 54 for transporting that piece to any square at the edge of the board including the castle shadow sections 52 and excluding the castle tiers for all pieces other than the king. Additionally, a portal move by one player (the moving player) triggers an opening of the other player's portcullis to expose that player's treasure which becomes unguarded, while at the same time, closing the moving player's gate if that gate had been opened (as only one gate may be opened at a time). As such, entering jester's portal 54 makes the opponent's treasure vulnerable to be taken or placed in check by any other piece on the board.

King's Portal Move

In embodiments, the king piece is the only piece that can transport to the opponent's treasure room (as well as other squares at the edge of the board) upon entering the jester's portal. With this move, the other player's portcullis opens, so that the moving player can win the game by capturing the exposed treasure in the moving player's next move. In some embodiments, the opponent player may still defend the treasure after the moving player's king has entered the opponent player's castle tiers, by entering the portal with any one of the opponent player's pieces in the following move, to close that player's portcullis and capture the opponent's king. In further embodiments, the player whose king has been captured will have a chance to open the opponent's portcullis to save the king and/or win the game in the next move. Such move may be repeated by the players until one of the players wins the game.

Edge Transport Move

In certain embodiments, the rules of game system 1 include an "edge transport move" which permits any piece to start a move at one edge of the board, and to continue and complete that move through an opposite edge of the board, wherein the opposite edges of the board are treated as contiguous to one another. With specific reference to FIG. 1, edge 10A is opposite to edge 10B; and edge 10C is opposite to edge 10D. In this play, a straight move across a row of the board transports a piece from a first square at a first edge of the row to a second square at a second edge of the same row, wherein the first edge and the second edge are opposite one another, and wherein the piece may continue movement beyond the second square to complete the move; a diagonal move across multiple rows transports the piece from a first square at a first edge of one row, to a second square at a second edge of a second row which is directly adjacent to the first row, wherein the first edge and the second edge are opposite one another, and wherein the piece may continue movement beyond the second square to complete the move. (see "Jester movability" for examples of an edge transport move). In certain embodiments, while the rules of the game allow the pieces to freely move within the castle shadows sections, the rules may restrict the pieces from performing an edge transport move from the castle shadow sections, such that the pieces cannot edge transport into the castle section.

Jester Movability

In certain embodiments, the rules of game system 1 may permit a player to move the jester in "queen mode" or alternatively in "knight mode" in any given turn. In the queen mode, the jester may move in any direction, including forwards or diagonally without obstruction, similar to the queen's movability in traditional chess. In knight mode, the jester may move three squares at once, either two vertical one horizontal or one vertical and two horizontal, forward or backwards, similar to the knight's movability in traditional chess. Hence, the jester can perform a "vaulting" move over other pieces which may be in the way in the knight mode.

Figure 6:
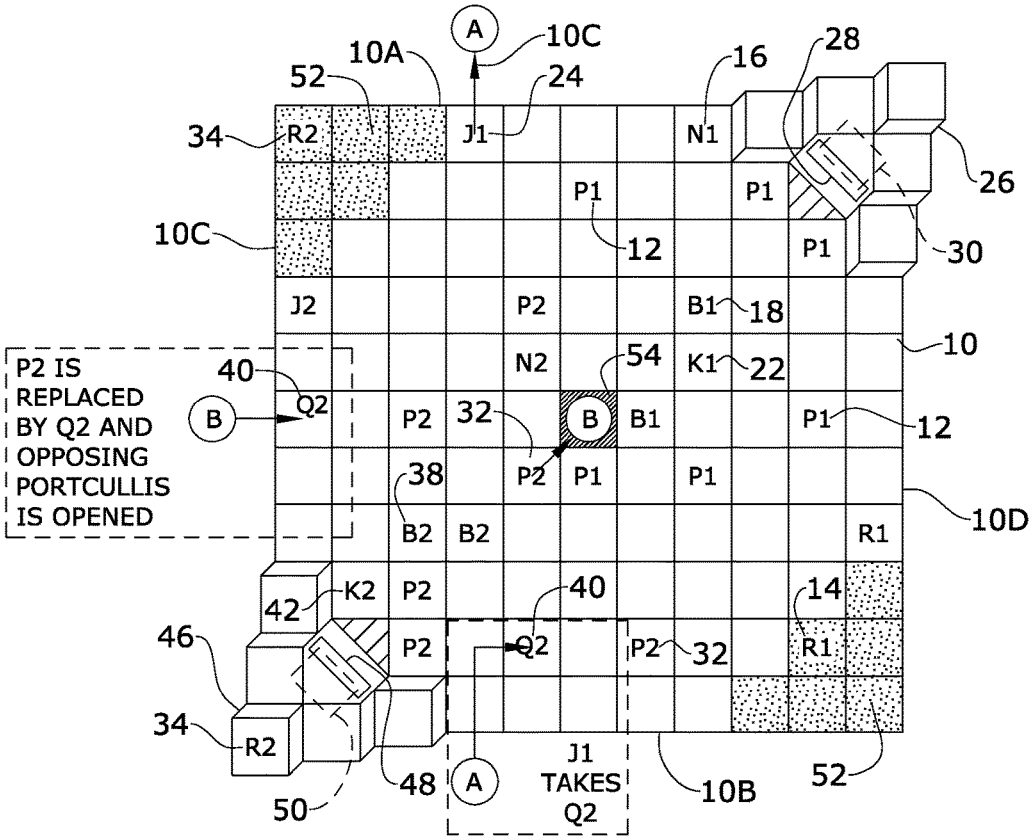
FIG. 6 illustrates movement of the game pieces for the game system of FIG. 1.

In certain embodiments, the rules of game system 1 may further allow the jester an edge transport move, wherein the jester can start a move at one edge of the board, and continue and complete that move through an opposite edge of the board, wherein the opposite edges of the board are treated as contiguous to one another. In this play, a straight move across a row of the board transports the jester from a first square at a first edge of the row to a second square at a second edge of the same row, wherein the first edge and the second edge are opposite one another, and wherein the jester may continue movement beyond the second square to complete the move; a diagonal move across multiple rows transports the jester from a first square at a first edge of one row, to a second square at a second edge of a second row which is directly adjacent to the first row, wherein the first edge and the second edge are opposite one another, and wherein the jester may continue movement beyond the second square to complete the move. An example of this is illustrated in FIG. 6, wherein jester 24 of player 1 initiates a knight mode move (A1) at edge 10A of the board and enters through edge 10B which is opposite edge 10A to complete the move (to capture player 2's queen 40 in this example).

Movement of Traditional Chess Pieces

In embodiments, the rules of game system 1 permit the remaining pieces to move as in traditional chess, but may further perform an edge transport move or a portal move, as described below.

In certain embodiments, the rules of game system 1 allow the king to move one square per turn, either diagonally or straight across from the starting square, wherein if the king captures a piece, then the king occupies that square of the captured piece (similar to a king piece in traditional chess). In certain embodiments, the rules of game system 1 may further allow the king an edge transport move, wherein the king can start a move at one edge of the board, and continue to complete that move through an opposite and corresponding edge of the board, wherein the opposite edges of the board are treated as contiguous with one another. As the king can move only one square per turn, in any edge transport move, the king starts at one edge and finishes the move at the opposite edge in the same row. Additionally, the rules of game system 1 do not allow another piece to capture the king via a portal move or an edge transport move. In further embodiments, any player may win the game by moving the king into the jester's portal 54, wherein the king is transported to the other player's castle treasure room via the jester's portal move to win the game. In embodiments, the king is the only piece that can move into the treasure room via a portal move. In some embodiments, the rules of game system 1 may require the king to be initially positioned within the king's own castle.

In embodiments, the queen may move straight or diagonally in any one direction per play, and may slide off an edge of the board to emerge from the opposite edge in an edge transport move. The queen may further transport to any square at the edge of the board, excluding the castle tiers, during a portal move.

In embodiments, the rook may move straight, in any one direction per play, and may slide off an edge of the board to emerge from the opposite edge in an edge transport move. The rook may further transport to any square at the edge of the board, excluding the castle tiers, during a portal move.

In embodiments, the bishop may move diagonally in any one direction per play and may slide off an edge of the board to emerge from the opposite edge in an edge transport move. During play, the bishop remains on a single color of square (even with an edge transport move), wherein the two bishops of each player cover alternate colors of the board. In certain embodiments, a bishop may switch board colors (while maintain diagonal movability) by going through the Jester's Portal to emerge on an edge square of the player's choice, excluding the castle tiers, during a portal move. Additionally, while the bishop cannot move within the castle sections, it can enter the opponent's treasure room.

In embodiments, the knight may move three squares at a time, two horizontal and one vertical or one horizontal two vertical, in forward or reverse directions. As such, the knight is the only piece besides the Jester that is able to jump over other pieces on the board. The knight may also slide off an edge of the board to emerge from the opposite edge in an edge transport move. The knight may further transport to any square at the edge of the board, excluding the castle tiers, during a portal move.

The pawn may move one space per play, horizontal or vertical, forward or backwards (including for the first play). The pawn may further move diagonally when capturing another piece. In certain embodiments, the pawn may move one box diagonally or straight to enter the Jester's portal. In embodiments, a pawn may replace the player's captured pieces by sliding off the board during an edge transport move, wherein the new piece may enter at the opposite edge where the pawn would have landed if completing an edge transport move. In a further embodiment, the pawn may replace a captured piece by entering the Jester's portal, wherein the player's captured piece may replace the pawn and re-enter to any edge square except the castle tiers.

Winning the Game

In embodiments, each player may defeat the opponent player and win the game according to at least one of the following methods: 1) placing the opponent player's king in check mate, 2) capturing the opponent's treasure, and/or 3) transporting the player's own king through the jester's portal to the opponent's castle treasure room.

Figure 7:
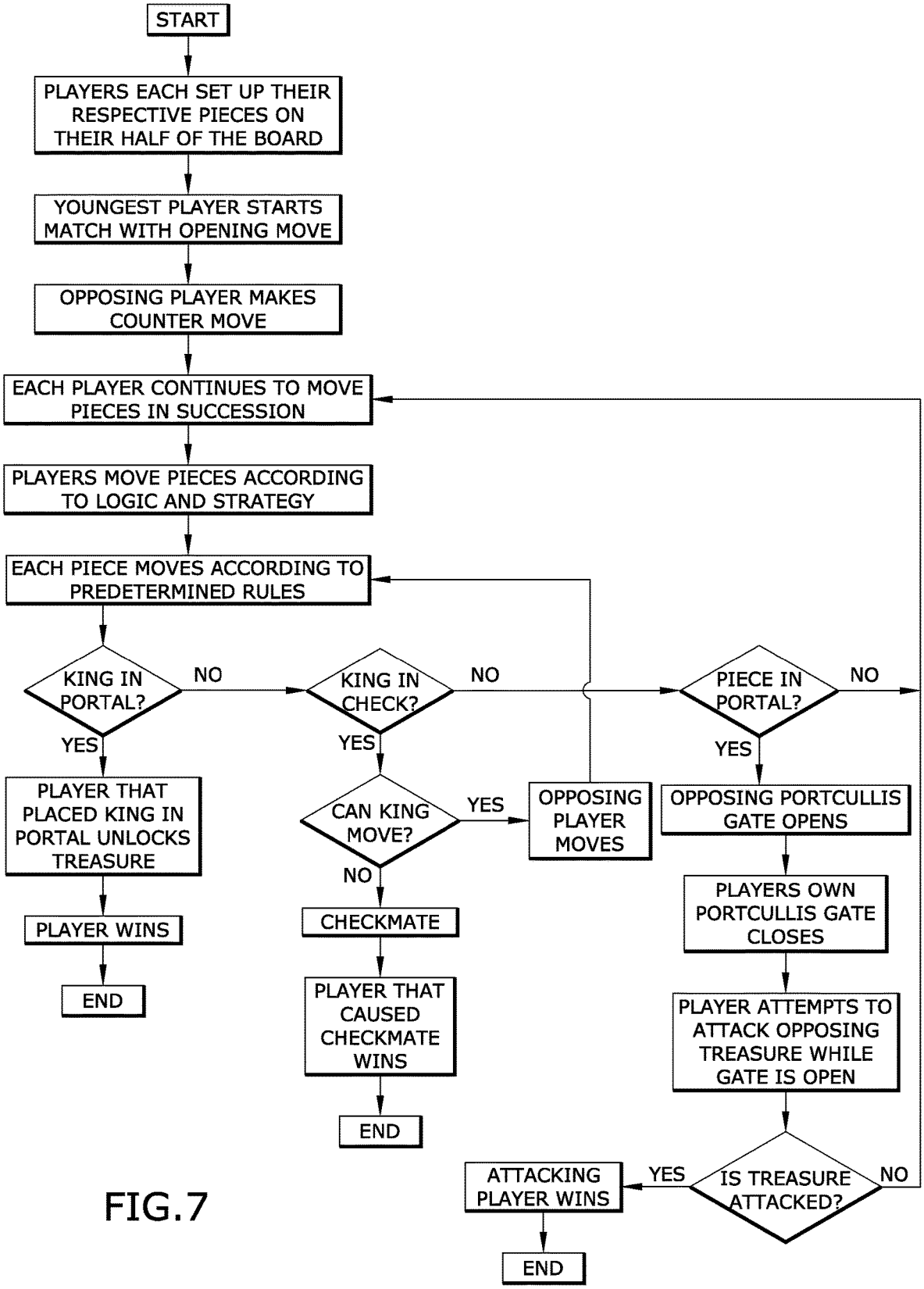
FIG. 7 is a flow chart for a chess-based game method in accordance with various embodiments.

With specific reference to FIG. 7, a method for playing the disclosed chess based game system 1 may comprise setting up the gameboard by each of two opponent players, then taking turns to move the pieces according to the game rules as described above, wherein a player may win the game by: 1) moving his/her king into the portal to capture the other player's treasure; 2) placing the other player's king in checkmate; and/or 3) attacking the other player's treasure while that player's portcullis gate is open.

The disclosed chess-based game system can be used in competitions and tournaments, and provides educational values of strategy, logic and problem solving.

It shall be appreciated that the disclosed chess-based game system can have multiple configurations in different embodiments. It shall be appreciated that the rules of game system 1 may vary in alternate embodiments. In certain embodiments, the game system may be implemented as a computer program and/or application, which may be played on one or more electronic devices, instead of on a physical gameboard. In certain embodiments, a computer implemented game system may be played over the internet by 2 players located remotely from one another. In further embodiments, a computerized game system may utilize 3-D and/or holographic images, animation, and various graphics.

It shall be appreciated that the components of game system 1 described in several embodiments herein may comprise any alternative known materials in the field and be of any size, dimensions, and/or design. It shall be appreciated that the components of game system 1 described herein may be manufactured and assembled using any known techniques in the field.

The constituent elements of the disclosed device and system listed herein are intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the disclosed system. Relationships between the various elements of the disclosed system as described herein are presented as illustrative examples only, and not intended to limit the scope or nature of the relationships between the various elements. Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A chess-based game system for play by two players, comprising, (a) a gameboard comprising a checkered eleven-by-eleven grid of 121 spaces including a center space designated as a jester's portal;

(b) a first multi-tiered castle occupying six of the spaces at a first corner of the gameboard, including a first elevated corner space forming a highest tier of the first castle, two elevated edge spaces adjacent to the first corner space on a first side of the first corner space, two elevated edge spaces adjacent to the first corner space on a second side of the first corner space, and a central space diagonally adjacent to the first corner space, wherein the first castle further comprises a first portcullis configured to guard the central space of the first castle;

(c) a second multi-tiered castle occupying six of the spaces at a second corner of the gameboard diagonally opposite the first corner, including a second elevated corner space forming a highest tier of the second castle, two elevated edge spaces adjacent to the second corner space on a first side of the second corner space, two elevated edge spaces adjacent to the second corner space on a second side of the second corner space, and a central space diagonally adjacent to the second corner space, wherein the second castle further comprises a second portcullis configured to guard the central space of the second castle;

(d) a first treasure piece located in the central space of the first castle and guarded by the first portcullis;

(e) a second treasure piece located in the central space of the second castle and guarded by the second portcullis;

(f) a set of first player game pieces comprising a king, a queen, two bishops, two knights, two rooks, eight pawns, and a jester piece; and (g) a set of second player game pieces comprising a king, a queen, two bishops, two knights, two rooks, eight pawns, and a jester piece.

* * * * *